United States Patent [19]

Palmer

[11] 4,408,365

[45] Oct. 11, 1983

[54] MATS

[75] Inventor: Deryk J. Palmer, Wolverhampton, England

[73] Assignee: Nuway Manufacturing Company Limited, England

[21] Appl. No.: 327,394

[22] Filed: Dec. 4, 1981

[30] Foreign Application Priority Data

Dec. 6, 1980 [GB] United Kingdom ..... 8039198

[51] Int. Cl.[3] ..... A47L 23/26

[52] U.S. Cl. ..... 15/112; 15/216; 428/54; 428/58; 428/137; 428/167; 428/188

[58] Field of Search ..... 15/215–217, 15/112; 428/52–54, 98, 99, 131, 137, 166, 167, 172, 178, 188, 58; 52/660, 582, 309.13, 309.16

[56] References Cited

FOREIGN PATENT DOCUMENTS 853401 11/1960 United Kingdom .

1055960 1/1967 United Kingdom .

2080105 2/1982 United Kingdom .

*Primary Examiner*—Alexander S. Thomas

*Attorney, Agent, or Firm*—Klarquist, Sparkman, Campbell, Leigh, Whinston & Dellett

[57] ABSTRACT

A mat of the kind having a plurality of first strips of rigid material such as aluminium, and a plurality of second strips of flexible material such as rubber, interposed alternately between the first strips, the first and second strips being secured together side-by-side by connecting means wherein said first strips each comprise an upper horizontal wall and a depending wall connected thereto, the apertures provided in said depending wall, and the or each connecting element extending through apertures in the first and second strips and being of such configuration so as to restrain the upper walls of the first strips from deforming downwardly to any substantial extent when a load is imposed.

6 Claims, 3 Drawing Figures

MATS

BACKGROUND OF THE INVENTION

This invention relates to a mat of the kind comprising a plurality of first strips of rigid, that is rigid or at least semi-rigid material, for example aluminium or plastics material such as polyvinylchloride or polypropylene, and a plurality of second strips of flexible material such as natural or synthetic rubber, interposed alternately between the first strips, the first and second strips being secured together in side-by-side relationship by means of one or more connecting elements, such as wires, which pass through aligned apertures in the first and second strips.

Previously, the first strips have been made of substantially H-configuration, the cross piece of the H in use, lying vertically, and having the apertures therein, the edges of the side pieces of the H abutting the adjacent flexible second strips. Such a mat is described in our previous U.K. Pat. No. 1,055,960.

The first strips have been made in H section so as to provide the necessary strength to withstand deformation when a load is imposed on the first strips, such as a person walking thereupon.

The apertures in the first and second strips have been made conveniently by punching as it has been found that a punching tool has a longer useful life than a drill, and punching is a quicker operation to perform than drilling.

Mats of the kind specified hitherto have been at least 1.7 centimeters thick. However, there is a long standing demand to provide a similar but thinner mat, for example, of substantially 1.2 centimeters deep. However, it has not been found possible hitherto to provide economically a mat of the type described of less than 1.7 centimeters depth merely by reducing the dimensions of the component parts of the known mats, for the following reasons.

To punch apertures in the cross piece of an H-configuration first strip, it is necessary to use a backing die to support the section on the opposite side of the cross piece to that which the punch enters, to prevent the strip from deforming. Thus, if the dimensions of the H-section first strips are reduced, it is not possible to insert such a backing die into the reduced space between the side pieces. If the apertures are punched in the cross piece, without a backing die, the section is damaged.

When making apertures in a second flexible strip, it was found that the strip burst in the region of the aperture during the punching operation when the thickness of the strip was reduced to that necessary to achieve the desired thinner mat. It has been found not possible to reduce the size of the connecting elements thereby permitting a reduction in the size of the apertures, since this results in a mat of inadequate strength being produced.

It is threfore an object of the present invention to provide a new and improved mat of the kind specified, and a method of making such a mat, which overcomes or reduces the above mentioned problems.

SUMMARY OF THE INVENTION

According to a first aspect of the invention we provide a mat of the kind specified wherein said first strips each comprise an upper wall which in use, lies substantially horizontally, and a depending wall connected to the upper wall, the apertures of the first strips being provided in said depending wall, and the or each connecting element which extends through the aligned apertures being of such configuration so as to restrain the upper walls of the first strips from deforming downwardly to any substantial extent when a load is imposed thereon at least in the region of the connecting element.

For example, the connecting element may prevent the upper walls from deforming downwardly beyond their elastic limit.

Thus it will be appreciated that in a mat in accordance with the invention, due to the support that the connecting element gives to the first strips, the first strips may be made of configurations other than H section thus enabling a thinner mat to be produced than has hitherto been possible.

In a preferred embodiment, the first strips are of channel section, the channel in use, opening horizontally, the apertures being provided in the base of the channel. Thus, as a load is imposed on the first strips, for example when a person walks upon the mat, the upper wall may thus engage the connecting element whereby the wall is restrained from deforming any further downwardly.

Further, as the first strips are of channel section, a suitable die may conveniently be positioned behind the base of the channel during manufacture and the apertures punched outwardly in the base from within the channel, thereby preventing the strip from deforming.

Preferably at least some of the first strips have an abutment projecting upwardly from the upper wall, which abutment provides a scraping edge.

The first strips are preferably made as an aluminium extrusion although if desired, they may be made of a plastics extrusion or a moulding or a brass extrusion or any other suitable material.

The connecting elements may comprise U-shaped wires, the end portions of the U projecting outwardly of the mat and being bent over to rigidly assemble the first and second strips in side by side abutting relationship. The end strips are preferably made of a rigid or semi-rigid metal or plastics material such as an extrusion or moulding. The end strip adjacent the end portions of the U-shaped connecting element may have a groove to receive the bent-over portions of the U-shaped connecting element.

The second flexible strips preferably have had the apertures therein formed by means of a rotatable punching tool.

The second flexible strips may comprise rubber or other polymeric material having a fibre such as nylon embedded therein, to provide a wiping surface for a user of the mat. Such strips may be made from used vehicle tires as is well known, or especially provided to a hard wearing specification.

According to a second aspect of the invention we provide a mat of the kind specified wherein the first strips are of channel configuration, the channel opening horizontally, the apertures being provided in the base of the channel, the connecting elements passing through the apertures.

According to a third aspect of the invention, we provide a method of making a mat according to the first or second aspects of the invention, including the steps of forming the apertures in the dependent wall by placing a backing die adjacent a surface of the wall which is on the opposite side thereof to the top wall and forming the apertures in the wall with a punching tool by punching from the same side of the wall as the top wall, laying the first strip adjacent a second strip with the thus formed aperture of the first strip being aligned with a previously formed aperture of the second strip, and inserting a connecting element in the aligned apertures to connect the two strips together.

Preferably, the aperture in the second flexible strip is also formed by punching but, to prevent the second flexible strip from becoming damaged as the aperture is punched therein, the punching tool is preferably rotated as it is inserted.

According to a fourth aspect of the present invention we provide a method of manufacturing a mat according to the first or second aspects of the invention including the steps of moving a punch axially and rotatably to form an aperture in a second strip laying the second strip adjacent a first strip, with the thus formed aperture of the second strip being aligned with a previously formed aperture of the first strip, and inserting a connecting element in the aligned apertures to connect the two strips together.

Preferably, the punching tool which is used to provide the aperture in the second flexible strip comprises a hollow tubular member having a main body part with a sharpened end which may be of reduced size compared with the main body part whereby when the punching tool passes through the second flexible strip, that part of the strip punched from the strip may be removed from the strip through the bore of the tubular member.

If desired, a plurality of apertures may be punched in a first and/or in a second strip simultaneously.

BRIEF DESCRIPTION OF THE DRAWINGS

The invention will now be described with the aid of the accompanying drawings in which.

DETAILED DESCRIPTION

Figure 1:
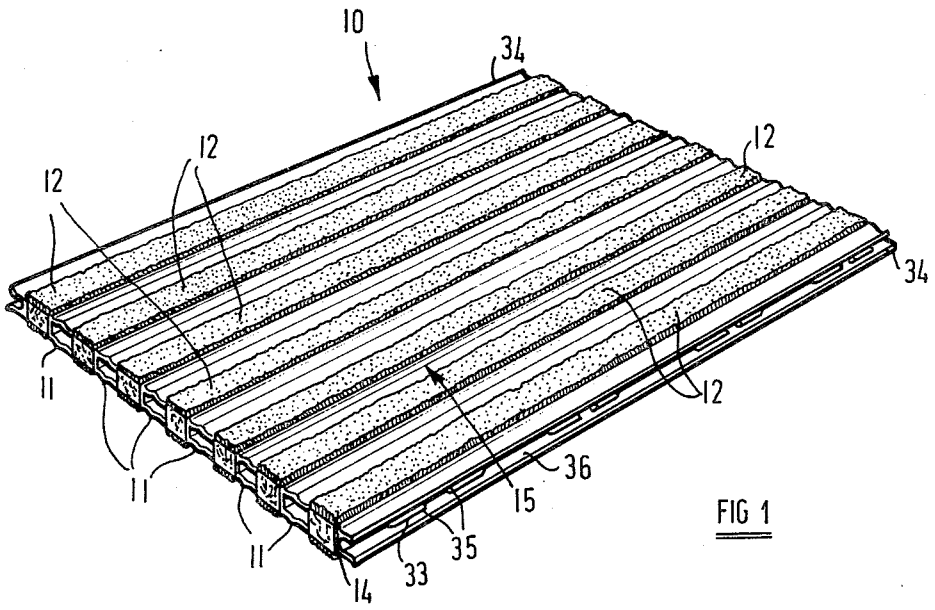
FIG. 1 is a perspective view of part of a mat in accordance with the invention.
Figure 2:
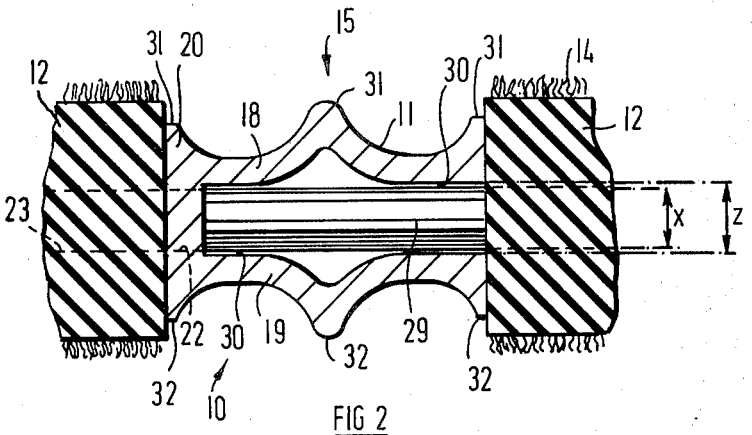
FIG. 2 is an enlarged end view of part of the mat of FIG. 1.
Figure 3:
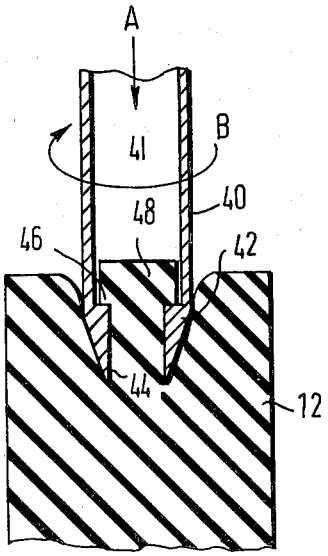
FIG. 3 is a sectional view of a punch making an aperture through a second flexible strip.

Referring to FIGS. 1 and 2, a mat 10 comprises a plurality of rigid or semi-rigid extruded aluminium strips 11 having interposed therebetween a plurality of flexible strips 12 made of natural or synthetic rubber and which each have nylon fibres 14 embedded therein, part of the rubber having been removed to reveal the fibres to provide a foot wiping surface 15.

Such strips may be made from used vehicle tires by buffing the surface thereof to remove a layer of rubber and so reveal the nylon fibres embedded therein to produce a pile.

The strips may be made of any other flexible material suitable for foot-wiping applications and may be provided with a surface layer such as a carpet strip secured to a main part.

In known mats, the strips 11 are of H configuration so as to provide the necessary strength. However, in the mat 10 shown, substantially channel-shaped strips 11 and are provided and strengthed as follows.

The channels 11 each comprise an upper wall 18 and a lower wall 19 with a base part 20, which in use depends substantially vertically downwardly from the upper wall 18 to the lower wall 19. Both the base parts 20 of the strips 11 and the strips 12 each have a plurality of circular apertures 22, 23 therein, respectively. The apertures 22, 23 are aligned and connecting elements comprising U-shaped round wires 29 are inserted therein. The apertures 22, 23 and the wires 29 are of approximately the same diameter X, which diameter is slightly smaller than the distance Z between the upper and lower walls 18, 19 of the channels 11 at their closest points 30.

Thus, as a load, such as a person walking on the mat 10, is imposed on the strips 11, the upper walls 18 of the channels 11 will be deformed downwardly until the walls 18, engage the wires 29, which restrain the upper walls 18 from any further downward movement and thus prevent the walls 18 from deforming beyond their elastic limit. When the load is released, the walls 18, spring upwardly once again. Thus the upper walls 18, of the strips are supported by the wires 29 as they are deformed thus enabling channel shaped strips 11 to be used instead of conventional H-shaped strips.

Although the channels 11 described are aluminium extrusions, if desired, they may be extruded or moulded from any other metal, or a suitable plastics material such as polyvinylchloride or polypropylene.

Each channel 11 has three upwardly projecting abutments 31 which provide a scraping surface. Similarly, downwardly projecting abutments 32 are provided to enable the mat to be inverted, in which case when a load is imposed on the strips 11, the walls 19 will deform downwardly until they engage and are restrained by the wires 29.

If desired, the strips 11 may be of any other configuration which requires the restraint of connecting elements.

The wires 29 are of U configuration, the ends 33 of the U being passed through apertures in an end strip 34 and being bent over as shown at 35 to engage in a groove 36 of the end strip 34. The opposite end of the mat also has an end strip 34 having a groove (not shown) in which the closed end of the U is located.

Thus the mat 10 is assembled with the strips 11, 12 alternatively arranged in rigid abutting side by side relationship, by the connecting elements 29, although the mat may be assembled by any other connecting elements provided that their configuration is such as to support the strips 11 from deforming downwardly beyond their elastic limit when a load is applied thereto.

The apertures 22, 23 are conveniently made by punching as it has been found that a punching tool lasts longer than a drill, and punching is a simpler, quicker operation than drilling.

The mat 10 shown is thin, i.e. substantially 1.2 centimeters thin. This compares with known mats which are commonly at least 1.7 centimeters thick.

It is not convenient or economic merely to scale down the dimensions of the various component parts of known mats having H-section strips 11 as it would not be possible to insert a backing die between the reduced space between the side pieces of the H section strips and to punch the apertures as is conventionally done, due to the restriction in size. However, in the mat 10 described above, as the strips 11 are of channel configuration, it is possible to provide a backing die behind the outer surface of the base of the channels 11 and to punch the apertures 22 outwardly from within the openings of the channels 11.

The flexible strips 12 need also to be of reduced thickness, but they could be easily damaged i.e. burst by punching holes which are too large compared with the reduced thickness of the strips 12.

This problem is overcome by punching the holes 23 in the flexible strips 12 as follows.

Referring to FIG. 4, there is shown a punching tool 40 comprising a substantially tubular member having a bore 41 and a lower end 42 of outwardly tapered configuration and a sharp edge 44. The punching tool 40 is inserted into the strips 12 both by moving it axially in the direction of the arrow A, whilst rotating it about the axis thereof as arrow B. It has been found that by punching the apertures 23 by this method, that the flexible strips do not burst.

A further advantage of the punching tool 40 shown is that a shoulder 46 is provided whereby the bore 41 is of larger diameter over the major body part thereof than at the lower end 42. This enables the rubber part 48 which is punched out by the punching tool, to be easily removed.

Thus a mat in accordance with the present invention can be made thinner than conventional mats which is desirable in many applications.

I claim:

1. A mat comprising a plurality of first strips of rigid material each of channel section comprising an upper wall and a base wall, means connecting the base wall to the upper wall, a lower wall, and means connecting the base wall to the lower wall, whereby the channel, in use, opens horizontally, a plurality of second strips of material more flexible than the first strips, interposed alternately between the first strips, a connecting element securing the first and second strips together in side by side relationship, aligned apertures in the first and second strips, the apertures in the first strips being provided in said base wall, the connecting element passing through the aligned apertures and in use, restraining the upper walls of the first strips from deforming downwardly to any substantial extent when a load is imposed on the mat, at least in the region of the connecting element.

2. A mat according to claim 1 wherein at least some of the first strips have an abutment projecting upwardly from the upper wall, which abutment provides a scraping edge.

3. A mat according to claim 1 wherein the first strips are made as extrusions.

4. A mat according to claim 1 wherein the connecting element comprises a U-shaped wire, the end portions of the U projecting outwardly of the mat and having bent over portions to rigidly assemble the first and second strips in side by side abutting relationship.

5. A mat according to claim 4 wherein the end strips are made of a rigid material, the end strip adjacent the end portions of the U-shaped connecting element having a groove to receive the bent-over portions of the U-shaped connecting element.

6. A mat according to claim 1 wherein the second flexible strips comprise a polymeric material having a fibre embedded therein, to provide a wiping surface for a user of the mat.

* * * * *